US008596502B2

(12) United States Patent
Kwasny

(10) Patent No.: US 8,596,502 B2
(45) Date of Patent: Dec. 3, 2013

(54) TWO-COMPONENT BAROMETRIC CELL HAVING A SEALED TRIGGERING MECHANISM

(75) Inventor: Hans-Peter Kwasny, Heilbronn (DE)

(73) Assignee: Kwasny GmbH (DE)

( * ) Notice: Subject to any disclaimer, the term of this patent is extended or adjusted under 35 U.S.C. 154(b) by 553 days.

(21) Appl. No.: 12/525,038

(22) PCT Filed: Jan. 31, 2008

(86) PCT No.: PCT/EP2008/000735

§ 371 (c)(1), (2), (4) Date: Oct. 28, 2009

(87) PCT Pub. No.: WO2008/092670

PCT Pub. Date: Aug. 7, 2008

(65) Prior Publication Data

US 2010/0155423 A1 Jun. 24, 2010

(30) Foreign Application Priority Data

Feb. 2, 2007 (DE) ..... 10 2007 006 097

(51) Int. Cl.
*B65D 83/00* (2006.01)

(52) U.S. Cl.
USPC ..... 222/402.21; 222/135

(58) Field of Classification Search
USPC ..... 222/402.21, 402.25, 402.1, 135, 145.1, 222/145.5, 130, 394, 80, 83, 83.5; 206/222, 206/219
See application file for complete search history.

(56) References Cited

U.S. PATENT DOCUMENTS

| | | | | |
|---|---|---|---|---|
| 4,651,899 | A * | 3/1987 | Pauls et al. | 222/130 |
| 5,692,644 | A * | 12/1997 | Gueret | 222/80 |
| 6,305,576 | B1 * | 10/2001 | Leoncavallo | 222/83.5 |
| 2004/0144808 | A1 * | 7/2004 | Kwasny et al. | 222/402.1 |
| 2006/0201969 | A1 * | 9/2006 | Kwasny | 222/135 |

FOREIGN PATENT DOCUMENTS

JP 2001-171762 * 6/2001

* cited by examiner

*Primary Examiner* — Lien Ngo
(74) *Attorney, Agent, or Firm* — Berliner & Associates

(57) ABSTRACT

The invention relates to a pressurized can comprising a body (2), a dome (3) accommodating a valve (4), a concavely shaped bottom (5), an inner casing (7) attached to a cup (6) located in bottom (5), a push rod (9) arranged in the inner casing (7), said push rod (9) being actuated through the cup (6) and intended to force open the inner casing (7), with said inner casing (7) being joined to the cup (6) via a spring cage (11), said spring cage (11) containing a spring-loaded trigger (12) the bottom-side end of which extending through the cup (6) and acting on the push rod (9), said push rod (9) acting on a membrane (8) arranged at the valve-side end of inner casing (7), said membrane at its valve-side end sealing off the inner casing (7) hermetically against the contents of the pressurized can (1) and being forced open by the push rod (9) actuated by means of trigger element (12), with the spring cage (11) being designed so as to be closed off at its valve side and the trigger element (12) being provided at its bottom side with a sealing element (26) acting against the inner wall of the spring cage.

19 Claims, 5 Drawing Sheets

--PRIOR ART--

Fig. 2a
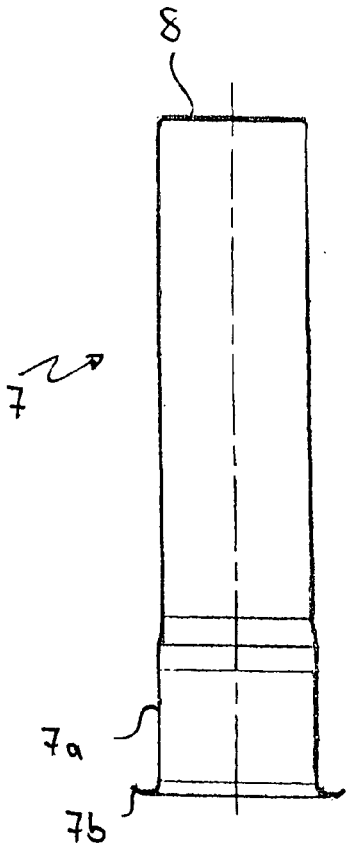
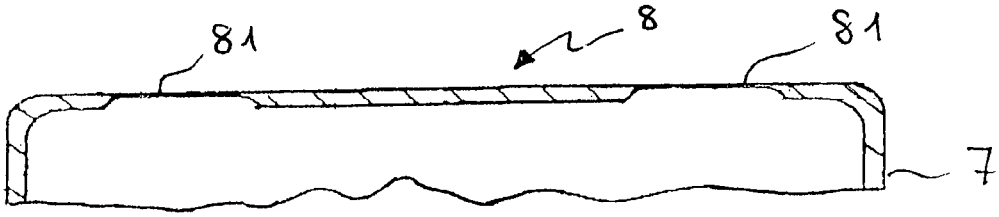
Fig. 2b

TWO-COMPONENT BAROMETRIC CELL HAVING A SEALED TRIGGERING MECHANISM

The invention relates to a pressurized can with a body, a dome accommodating a valve, a concavely shaped bottom, an inner casing attached to a cup located in the bottom, a push rod arranged in the inner casing, said rod being actuated through the cup and intended to force open the inner casing, with said inner casing being joined to the cup via a spring cage, said spring cage containing a spring-loaded trigger element the bottom-side end of which passing through the cup and acting on the push rod, with said push rod acting on a membrane arranged at the valve-side end of the inner casing, said membrane sealing off the inner casing at its valve-side end hermetically against the contents of the pressurized can and being forced open when the trigger is actuated by the push rod, with the spring cage being designed so as to be closed at the valve end and the trigger at the bottom side being provided with a sealing element acting on the inner wall of the spring cage.

The invention also relates in particular to the design of pressurized cans which, in addition to the substances of the main component, accommodate a second component in the inner casing, said second component reacting with the main component to form the finished product, a multi-component coating. Furthermore, the invention can also be used for other two-component formulations, for example for treating or finishing surfaces or generating plastic foams.

The substances of the main component contained in the pressurized can are liquid and consist, for example, of a curable coating binder, solvents and the liquid propellant that serves to dispense the component. The second, curing component is contained, in a relatively small amount, in an inner casing and consists primarily of a compound reacting quickly with the main component, for example a polyisocyanate suited to react with polyol-containing components present in the main component. Catalysts may be present, where appropriate. The component contained in the inner casing serves to influence the curing process and the quality of the product, usually by accelerating the curing process, increasing the strength or improving the weathering resistance or similar properties. As a rule, by forcing off the cover of the inner casing the second component is released into the pressurized can shortly before the foam is discharged and is mixed with the main component by shaking the can.

The basic pattern of such two-component aerosol cans has been described in publication WO 85/00157 A. The pressurized can proposed there is provided with an additional casing arranged inside the can and accommodating another component. At the valve side of this inner container a cover is arranged which can be forced off by a rod extending through the bottom of the pressurized can and the inside of the inner casing. This rod is movably supported inside the inner casing and introduced through a seal arranged in the beaded cup of the can base. A pressurized can according to WO 85/00157 A is shown in FIG. 1.

An advancement of this known pressurized can has been disclosed by WO 2004/056660 A. in accordance with one of the variants described there the inner casing is provided with an integral cover and is directly attached to the can bottom by crimping. A trigger element passing through a bottom cup of the can bottom and being supported in a spring cage acts on a push rod located inside the inner casing, said push rod forcing open the integral cover of the inner casing when pressure is exerted.

As described in publication WO 2004/056660 leakage problems have frequently been encountered with two-component aerosol cans of this type which in particular also applies to the interior of the pressurized can. Initial developments in this context thus revealed drawbacks in that reactions occurred again and again between the contents of can and casing in the area of the cover leading to bonding impairing the product quality as well as can actuation. This problem was resolved by providing an integral design of casing and cover as per WO 2004/056660. However, the integral connection of casing and cover described in that publication led to a situation in that forcing the cover open by means of the push rod was often irregular and created too small an opening so that mixing can with casing contents was impeded.

Another more serious problem occurred in the area of the bottom-side end of the inner casing. After a longer storage period the trigger element supported there in a spring cage can only be actuated by exerting excessive force. This is presumably due to water evolving from air humidity passing through the sealing system, polymerization and polymerizate deposits of the casing contents in the area of the helical spring.

Therefore, the objective of the invention is to enhance the design of the pressurized can known from WO 2004/056660 to make sure the above described disadvantages are no longer experienced.

This objective is achieved with a pressurized can of the type first mentioned above which provides for the spring cage being designed so as to be closed at the valve end and the trigger element at the bottom side being provided with a sealing element acting on the inner wall of the spring cage.

As used hereinafter, the term "bottom side" denotes the end of a part pointing towards the can bottom, "valve side" means the end of an object pointing towards the valve, and "can side" is to be understood as the side of a component facing towards the interior of the can.

The inner casing as used for the purpose of the invention is provided on the valve side with a membrane which makes it possible to keep the remaining can contents completely separate in this critical area—thus dispensing with the customary separate sealing elements used hitherto, for example O-rings. The membrane may be attached to the inner casing by glueing, welding or threading or designed so as to be integral with the inner casing, i.e. inner casing and membrane form a single piece. In the case of a glued-on membrane, the membrane itself is expediently provided, around its circumference, with a rim which when the membrane is placed on the inner casing extends a few millimeters over the casing and is tightly glued in place. Alternatively, the rim may be provided with a female thread and at the can side end screwed onto a male thread provided on the inner casing and, if considered necessary, be additionally attached by glueing. Manufacturing inner casing and membrane to form an integral unit is especially useful.

The glues used in the invention are, in particular, conventional two-component glue systems, for example amine-hardening epoxy glues or amine- or OH-hardening polyisocyanate glues. The selection of the glues is governed by their resistance to the specific can contents; the most suitable glue system may be determined by simple testing.

The inner casing used in the pressurized cans proposed by the invention may be manufactured from customary materials, but is preferably made of aluminum. Plastic variants, for example polypropylene, are also suitable. However, where the inner casing forms an integral part of the bottom cup and where cans are pressurized using high pressure levels, an adequately pressure-resistant material must be used. Best suited for this purpose is aluminum. However, tinplate may also be employed. The techniques according to which the relevant plastic and metal parts are manufactured are known per se by those skilled in the art.

Within the pressurized can the inner casing is attached to the bottom cup. The bottom cup is preferably a cup of the type customarily used at the valve-side end of the pressurized can for the purpose of integrating the valve unit into the can dome. Manufacturing such cups is very simple and costs little. This provides an advantage in that there is no need to manufacture separate bottom cups.

The open side of the inner casing and the bottom cup are attached to the can bottom by crimping in a manner known per se.

Inside the inner casing a spring cage has been arranged which is secured in a can-side recess provided in the bottom cup. The spring cage is a plastic sleeve which, other than prior art cages, is provided with a membrane at its valve-side end preventing the ingress of cross-linking agent from the inner casing. The thickness of the membrane is such that, for the purpose of opening the inner casing, it can be pierced through by the trigger element supported inside the spring cage and in this manner allowing the push rod supported inside the inner casing to be moved against the valve-side casing membrane to be forced open. On the other hand, to avoid it from being pierced through inadvertently this membrane is strong enough to withstand to a certain extent the action of the trigger element.

Expediently, the receptacle of the bottom cup and the valve-side end of the spring cage are clinched or crimped together and, with a view to optimizing the connection, the spring cage may have a circumferential projection or a circumferential groove in the area of its bottom-side end, over or into which the receptacle is placed. Inside the receptacle immediately adjacent to the bottom-side end of the spring cage a gasket is expediently arranged having a central opening through which the trigger element located in the spring cage projects with its bottom-side end to the outside of the pressurized can.

At its valve-side end the spring cage has a circumferential inner projection serving as abutment for the helical spring arranged in the spring cage. The helical spring surrounds the trigger pin and with its bottom-side end rests on a circumferential projection provided on the trigger pin.

With its bottom-side end the trigger element protrudes through a gasket and a central opening arranged in the cup of the pressurized can. In the area of the above mentioned circumferential projection the trigger element is provided with a sealing element acting against the inner wall of the spring cage and preventing the contents of the inner casing from entering the spring cage from the bottom side. Said sealing element may be an O-ring arranged in a circular groove.

The central cut-out in the cup supporting the spring cage is located on the can side of the cup and points outwardly so that it is capable of accommodating the spring cage with its bottom-side end. From the outside the spring cage is secured in the receptacle by a clinching method, with the cage's bottom-side end acting against the sealing gasket also arranged inside the receptacle, thus holding the gasket in position.

In an expedient embodiment the push rod located inside the inner casing and actuated by the trigger element through the membrane of the spring cage has several wings arranged along a central axis, in particular four wings. The wings serve to stabilize the push rod inside the inner casing without the need for a push rod of unduly large volume. In order to further reduce the volume of the push rod, recesses or cut-outs may be provided. As the push rod and the trigger element are separate units specific means for guiding and stabilizing the push rod are indispensable. The wing structure in particular is conducive to the discharge of inner casing contents into the pressurized can and aids mixing of casing and pressurized can contents. To facilitate the piercing of the inner casing membrane and obtain the largest possible opening, it is expedient to suitably design the valve-side end of the push rod, for example by shaping it so as to form a sloped and sharp-edged hollow cylinder, if necessary, providing it with a sharp-edged pointed tip at the point closest to the valve. Thus a first point of contact between the push rod and the membrane is created at the push rod periphery, and the membrane is first perforated at this point and, as the push rod progresses, a roughly circular opening is stamped or cut out of the membrane.

It has proved especially expedient, however, to shape the push rod tip into a dovetail profile, with two opposing wings of the push rod peripherally forming a tip while the valve side wing edges run back to a point on the central axis which is nearer to the bottom. Shaping the push rod in this manner results in the inner casing membrane to be pierced through peripherally at opposing sides and furthermore causes a circular portion of the membrane to tear open, with the membrane remaining attached at one point between the two tips and thus folding open in a manner known from preserved food can ends.

This variant is especially effective in conjunction with a weakened zone arranged in the membrane of the inner casing where a ring-shaped or circular zone of reduced material thickness is provided. In particular, a ring-shaped weakened zone is considered expedient. In this area the thickness of the membrane material is lower, it ranges, for example, between approximately 50 and 70% of the normal wall thickness. The tip or tips of the push rod contact this weakened area and then pierce the membrane when the rod is actuated, with the membrane being ripped open along the outer line of the weakened zone and folding out.

The inner casing itself may be of constant diameter over its entire length. Preferred, however, is to provide a section of larger diameter at the bottom side, said diameter fitting exactly the inside diameter of the cup opening in the bottom through which the inner casing is inserted. The larger area of the inner casing facing away from the bottom has a slightly smaller diameter precisely interacting with the outer diameter of the push rod which makes it easier to insert the inner casing into the pressurized can through the bottom during assembly.

Another beneficial embodiment with respect to the spring cage is to provide a section of greater wall thickness in the area of the valve-side end immediately adjacent to the sealing membrane. This area of increased wall thickness, for example a wall thickness increased by 50%, improves the cage's resistance to deformation and facilitates piercing of the membrane by the trigger element.

To make it easier to pierce the membrane of the spring cage the trigger element at its valve side end is preferably of truncated-cone shape, for example with its end face being reduced by 50%. This, on the one hand, facilitates membrane piercing and, on the other, enables greater pressure to be exerted punctually on the bottom-side end of the push rod. By contrast, a cone-shaped pointed end would cause deformation in the tip area and thus create irregular triggering situations because the triggering travel may be shortened.

In all other respects, the pressurized can of the invention is manufactured and designed in the same manner as a conventional can. This applies in particular to the valve area and the valve-end equipment which permits, as the case may be, the pressurized can to be used both manually and with a spray gun.

The invention is explained in more detail by way of the enclosed figures where

FIG. 2 shows an inner casing for a pressurized can according to the invention;

FIGS. 1 to 6 are sectional drawings.

Figure 1:
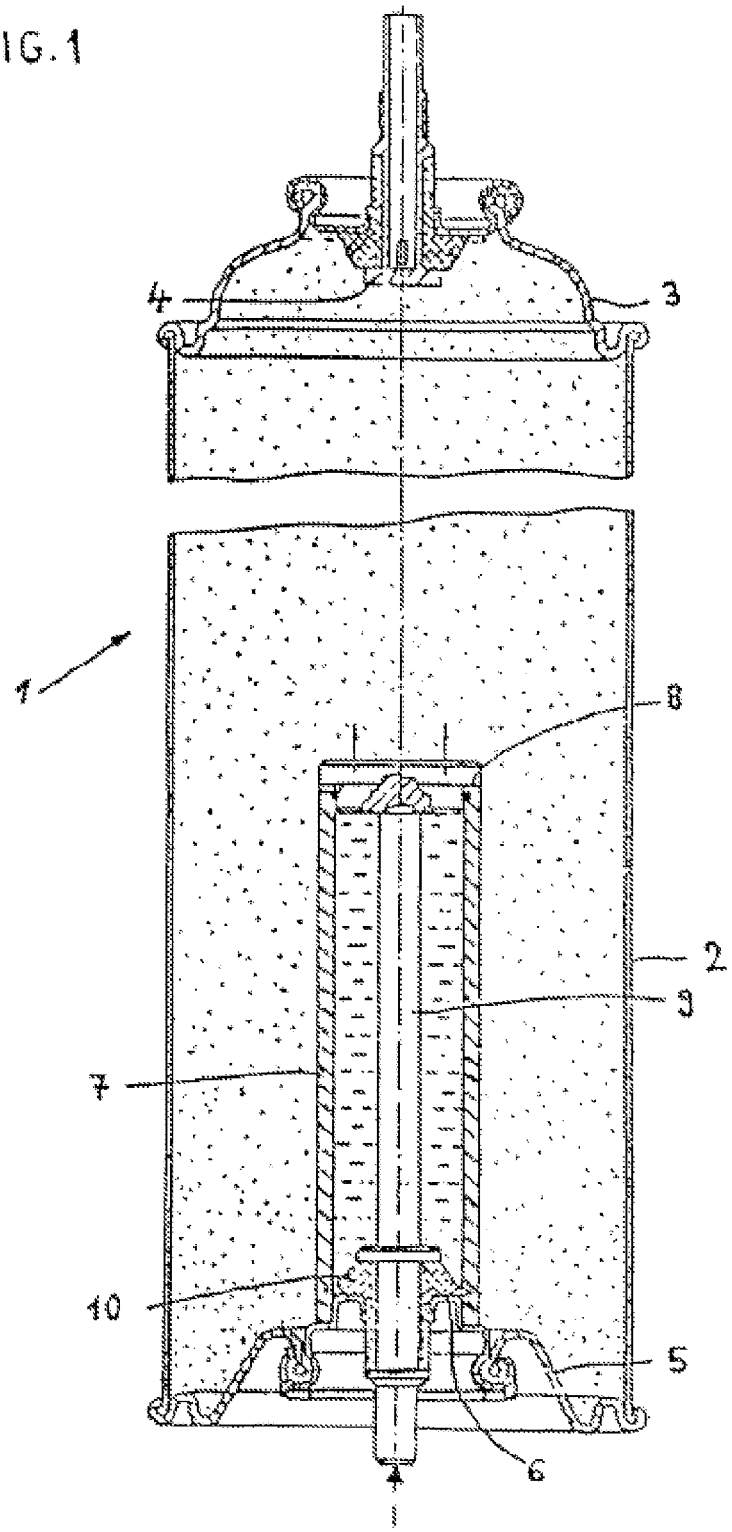
FIG. 1 shows a pressurized can with an inner casing according to WO 85/00157 A.

The pressurized can 1 according to FIG. 1 consists of a body 2, which is closed off by means of a dome 3 at its upper end. Dome 3 is connected to the body by means of interlocked flanges which provide also a tight seal between these components. The dome 3 is made from a round blank cut from sheet metal and formed into the domed shape shown on the drawing. The inner rim of the dome 3 is also provided with a flange by which it is joined to a valve cup holding a valve 4.

The bottom 5 is also joined to the body 2 by means of interlocked flanges and is equipped, in its center, with a bottom cup 6, above which the inner casing 7 is located. The inner casing 7 is provided with a cover 8 that can be forced off. Inside the inner casing 7, there is a push rod 9, whose end projects through a sealing element 10 from the bottom of the pressurized can. On both sides of the sealing element 10 the push rod is equipped with stops, both of which act on the sealing element 10 and limit the free travel of the push rod 9 inside the inner casing 7. For the purpose of forcing cover 8 off the inner casing 7 the push rod 9 is pressed in upward direction by striking the can base or bottom onto a firm surface. The rubber-elastic sealing element 10 absorbs this upward movement and, once the cover 8 has been forced off, pushes push rod 9 back into its initial position.

The functional principle of the pressurized can illustrated in FIG. 1 also applies to the pressurized can of the present invention. This means the invention proposes that the can as per FIG. 1 can be equipped with the casing component illustrated in FIG. 2.

FIG. 2 shows a casing 7 to be used in accordance with the invention. The inner casing 7 has a cylindrical wall and on the valve side is closed off by membrane 8. Membrane 8 and casing wall are of integral design, that is, consist of a deep drawn material, preferably aluminum.

At its valve-side end the inner casing 7 has a constant diameter which slightly enlarges towards the bottom-side end to form a diameter that corresponds with the diameter of a central opening provided in bottom 5. The smaller valve-side end facilitates insertion of the casing during assembly, while the slightly wider bottom-side end 7*a* enables the casing to be well seated in bottom 5 and crimping lips 6*a* (FIG. 5) of the bottom cup, with the circumferential projection 7*b* fitting into the crimping lips of the bottom cup 6 and, together with this cup, being attached to bottom 5 by crimping.

FIG. 2*b* is an enlarged sectional detail representation of the membrane 8 of the inner casing 7. It can be seen from the figure that the wall thickness of the weaker circular zone 81 is reduced in comparison to the normal wall thickness of the inner casing 7 and the central part of membrane 8. For example, the wall thickness of the inner casing may as a rule be 0.5 mm while it is reduced to a value ranging between 0.05 and 0.2 mm in the weaker zone. This can be achieved by using suitable tool configurations during the deep-drawing process of the inner casing.

Figure 3:
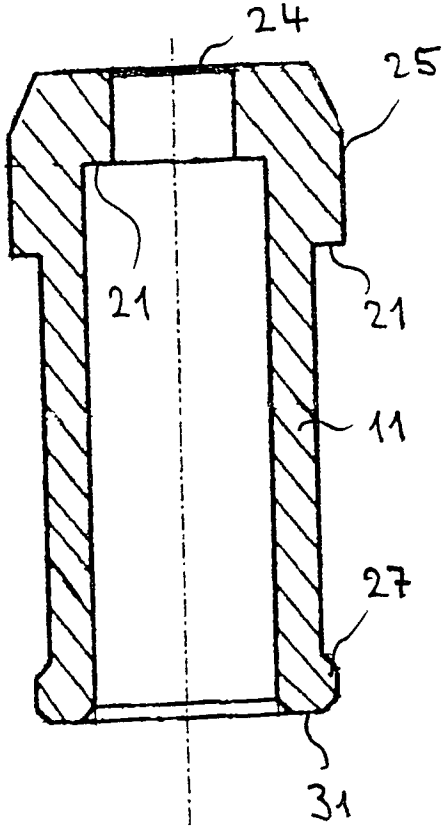
FIG. 3 shows a spring cage for a pressurized can according to the invention.

FIG. 3 illustrates an embodiment of a spring cage to be employed in the fabrication of the inventive can. The wall thickness of spring cage 11 in its valve-side area 25 is increased with a view to stabilizing the spring cage structure during actuation. On the valve side the spring cage is closed off by a membrane 24 of reduced wall thickness which can be forced open by action of the trigger element supported inside the spring cage. A circumferential inner projection 21 serves as abutment for a helical spring arranged inside. At its bottom-side end this helical spring rests on a projection provided on the trigger pin.

At its bottom-side end the spring cage has a circumferential projection 27 intended to facilitate the attachment of the bottom cup 6 by crimping. The bottom-side end 31 rests on a ring gasket arranged in the recess of the bottom cup 6.

The spring cage may consist of a suitable plastic material, for example polypropylene.

Figure 4:
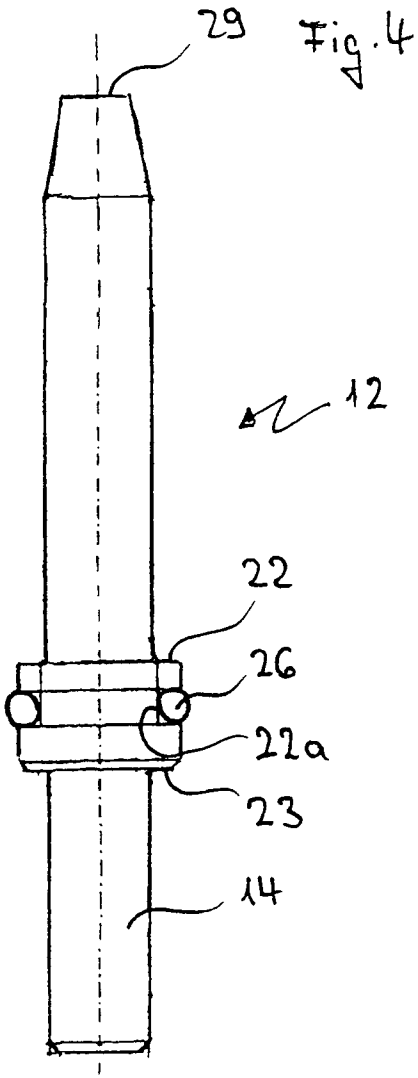
FIG. 4 shows a trigger element for a pressurized can according to the invention.

In FIG. 4 a trigger pin or element is depicted which may be used in conjunction with spring cage 11 and a helical spring. The trigger element has a tip 29 in the form of a truncated cone. The smaller surface of the pin makes it easier to pierce through the membrane thus causing membrane 24 to be torn open and fold away sideways; it nevertheless does not completely separate from the spring cage 11 and therefore cannot clog or jam the valve.

In its central area trigger element 12 has a circumferential projection 22, the valve-side end of which serves as abutment for the spring element and the bottom-side end 23 of which rests on the sealing element arranged in the bottom cup. In circumferential projection 22 a groove 23 is provided which accommodates an O-ring 26 acting on the inner wall of the spring cage 11 and thus preventing the media contained in the inner casing to enter the spring cage. The opposed end of the spring cage is sealed off by means of the membrane. Serving as actuating pin the bottom-side end 14 of the trigger element 12 extends through the bottom cup and protrudes from the pressurized can; pressing down the actuating pin causes the inner casing to be forced open and the cross-linking reaction to start in the pressurized can. Actuation of the pin may, for example, be brought about by means of a knob supported in the can bottom or by firmly putting the pressurized can down onto a level surface.

Figure 5:
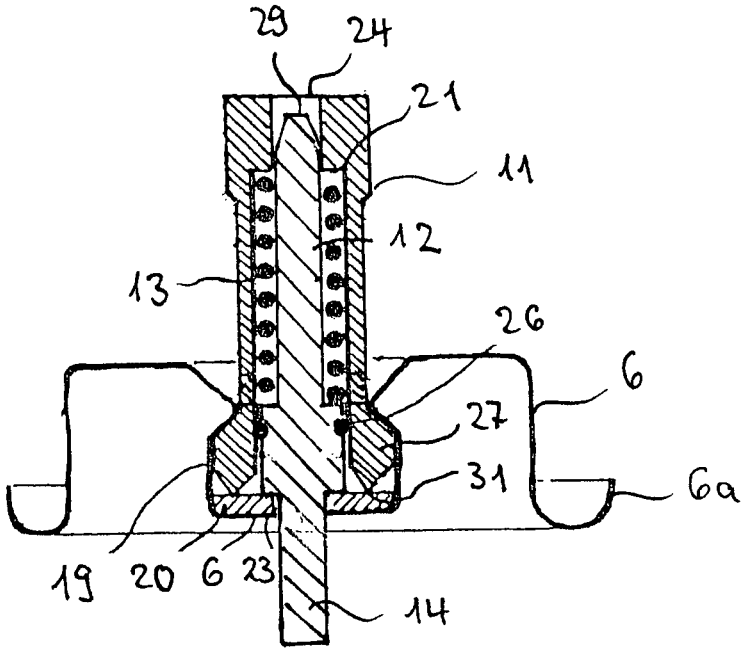
FIG. 5 shows a cup with spring cage and push rod.

FIG. 5 shows a bottom cup 6 together with spring cage 11 attached to it by crimping, with spring element 13 as well as trigger element 12 being arranged inside the cage.

Bottom cup 6 is provided with a circumferentially extending crimp projection 6*a* and in its center has been shaped into form 19 pointing to the can outside and being designed to accommodate spring cage 11 which is attached by crimping. In this form 19 which has been provided with a central opening a sealing gasket 20 is arranged acting against the bottom-side end 31 of spring cage 11. At its valve-side end the spring cage is provided with membrane 24 as well as circumferential inner projection 21 against which the helical spring 13 abuts.

Inside the spring cage 11 and helical spring 13 the trigger element 12 is located the valve-side end 29 of which is directly situated below the membrane 24. At its to valve-side end helical spring 13 abuts on the projection 21 of the spring cage and at its bottom-side end on the projection 22 (FIG. 4) of trigger element 12. Seal 26, an O-ring, is arranged in this projection, said O-ring acting on the inner wall of spring cage 11. Via its circumferential projection 23 the trigger element 12 acts against the bottom seal 20 which in turn abuts on an inwardly projecting portion of bottom cup 6. The bottom-side end 14 of the trigger element 12 protrudes from the pressurized can through the central opening of bottom cup 6 and in this way can be appropriately actuated from the outside.

Figure 6A:
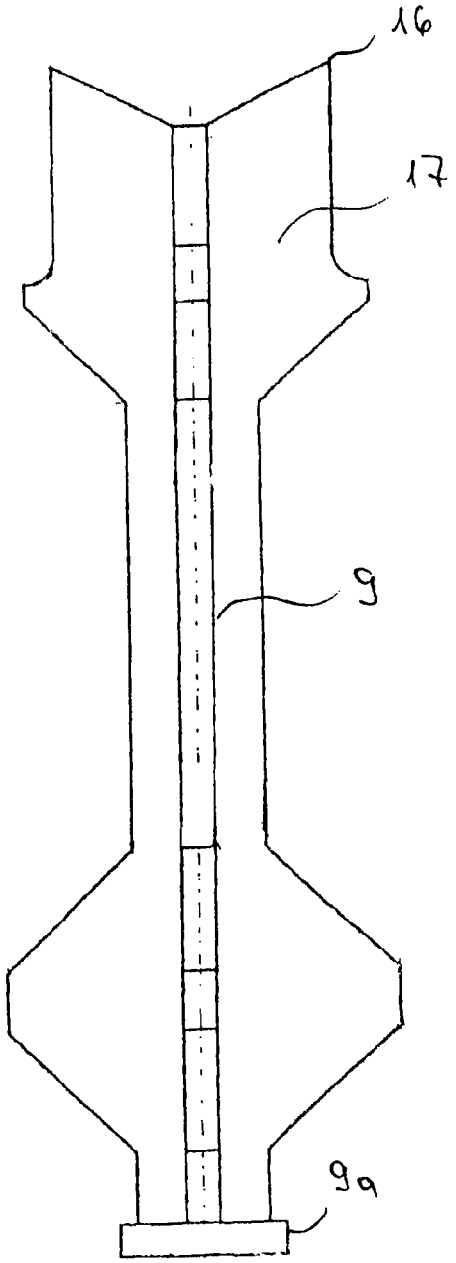
FIG. 6 shows a push rod with dovetail profile.
Figure 6B:
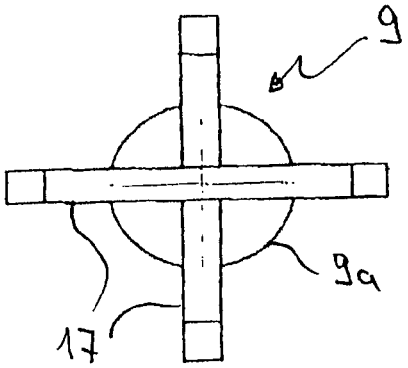

FIG. 6 shows a push rod which may be used to force open membrane 8 of the inner casing 7. The push rod 9 of this embodiment has four wing-shaped elements 17 of which two opposing ones have an outwardly protruding tip 16 thus forming a dovetail arrangement, with said tips being directed against the weaker zones 81 of the inner casing's membrane 8 (FIG. 2*b*).

The invention claimed is:

1. Pressurized can comprising a body (2), a dome (3) accommodating a valve (4), a concavely shaped bottom (5), an inner casing (7) attached to a cup (6) located in bottom (5), said inner casing comprising a valve-side end, a push rod (9) arranged in the inner casing (7), said push rod (9) being actuated through the cup (6) and intended to force open the inner casing (7), with said inner casing (7) being joined to the cup (6), and arranged inside the inner casing is a spring cage (11), said spring cage (11) containing a spring-loaded trigger (12) the bottom-side end of which extending through the cup (6) and acting on the push rod (9), said push rod (9) acting on a membrane (8) arranged at the valve-side end of inner casing (7), said membrane at its valve-side end sealing off the inner casing (7) hermetically against the contents of the pressurized can (1) and being forced open by the push rod (9) actuated by means of trigger element (12) characterized in that the spring cage (11) is designed so as to be closed off at its valve side end by a membrane (24) which is a part of the spring cage and the trigger element (12) is provided at its bottom side with a sealing element (26) acting against the inner wall of the spring cage.

2. Pressurized can according to claim 1, characterized in that the membrane (8) is glued, welded or screwed on to the inner casing (7).

3. Pressurized can according to claim 1, characterized in that the inner casing (7) and the membrane (8) form a one-piece unit.

4. Pressurized can according to any one of claims 1 to 3, characterized in that the inner casing (7) and the cup (6) are joined together by crimping.

5. Pressurized can according to any one of claims 1 to 3, characterized in that the spring cage (11) is secured in a central pocket (19) of the cup (6).

6. Pressurized can according to claim 5, characterized in that a seal (20) is arranged between the spring cage (11) and the cup (6) in the area of the central pocket (19).

7. Pressurized can according to claim 1, characterized in that the spring cage (11) is provided, at its valve-side end, with an inner projection (21) acting as an abutment for a spring element (13).

8. Pressurized can according to claim 7, characterized in that the trigger (12) is provided, at its bottom-side end, with a peripheral projection (22) acting as an abutment for the spring element (13).

9. Pressurized can according to claim 1, characterized in that the trigger (12) at its cup-side end has a sealing face (23) in the form of a circumferential projection which acts against a sealing gasket (20) arranged in a can-side recess (62) of the cup (6).

10. Pressurized can according to claim 1, characterized in that the inner casing (7) and the membrane (8) are made from aluminum.

11. Pressurized can according to claim 1, characterized in that the membrane (8) has a ring-shaped or circular zone (81) of reduced material thickness.

12. Pressurized can according to claim 1, characterized in that the inner casing (7) has at its bottom-side end a portion of larger diameter (7*a*) designed so as to match the inner diameter of the cup opening (61) arranged in bottom (5).

13. Pressurized can according to claim 1, characterized in that the spring cage (11) at its valve-side end is closed off by a membrane (24) the material thickness of which is lower than the wall thickness of the spring cage.

14. Pressurized can according to claim 1, characterized in that the spring cage (11) at its valve-side end is provided with a portion of greater wall thickness.

15. Pressurized can according to claim 1, characterized in that the trigger element (12) at its valve-side end has a truncated-cone shaped end portion.

16. Pressurized can according to claim 1, characterized in that the push rod (9) is provided with several wings (17) along a central axis.

17. Pressurized can according to claim 16, characterized in that the push rod (9) is of four-wing design and at its valve-side end has two opposing wings (17) forming a dovetail profile.

18. Pressurized can according to any of claim 16 or 17, characterized in that the wings (17) are provided with cut-outs or recesses.

19. Pressurized can comprising a body (2), a dome (3) accommodating a valve (4), a concavely shaped bottom (5), an inner casing (7) attached to a cup (6) located in bottom (5), said inner casing comprising a valve-side end, a push rod (9) arranged in the inner casing (7), said push rod (9) being actuated through the cup (6) and intended to force open the inner casing (7), with said inner casing (7) being joined to the cup (6), and arranged inside the inner casing is a spring cage (11), said spring cage (11) containing a spring-loaded trigger (12) the bottom-side end of which extending through the cup (6) and acting on the push rod (9), said push rod (9) acting on a membrane (8) arranged at the valve-side end of inner casing (7), said membrane at its valve-side end sealing off the inner casing (7) hermetically against the contents of the pressurized can (1) and being forced open by the push rod (9) actuated by means of trigger element (12) characterized in that the spring cage (11) comprises a membrane that closes off the spring cage at its valve side end by a membrane (24) which is a part of the spring cage and the trigger element (12) is provided at its bottom side with a sealing element (26) acting against the inner wall of the spring cage.

* * * * *